United States Patent [19]

Verschuur

[11] 4,234,320

[45] Nov. 18, 1980

[54] PROCESS FOR THE AGGLOMERATION OF SOLIDS

[75] Inventor: Eke Verschuur, Amsterdam, Netherlands

[73] Assignee: Shell Oil Company, Houston, Tex.

[21] Appl. No.: 32,063

[22] Filed: Apr. 23, 1979

[51] Int. Cl.[3] ..... C10L 5/14; C10L 5/16; C22B 1/14

[52] U.S. Cl. ..... 44/23; 44/24; 75/3

[58] Field of Search ..... 44/23, 24; 75/3

[56] References Cited

U.S. PATENT DOCUMENTS

| | | | |
|---|---|---|---|
| 3,041,161 | 6/1962 | Heinz et al. | 75/3 |
| 3,966,427 | 6/1976 | Herment et al. | 44/23 X |
| 4,003,737 | 1/1977 | Caswell et al. | 75/3 |
| 4,018,571 | 4/1977 | Cole et al. | 44/24 X |
| 4,126,426 | 11/1978 | Verschuur | 44/24 |
| 4,156,596 | 5/1979 | Capes et al. | 44/23 |

*Primary Examiner*—Carl F. Dees

[57] ABSTRACT

The present invention pertains to a two-stage agglomeration process for coal fines in the form of a pumpable slurry. The slurry is selectively agglomerated in the first stage by the addition of a hydrocarbon binder and the bulk of the water separated from the resulting agglomerates. Improved agglomerates are obtained in the second stage where those from the first stage are resubmitted to turbulent motion in hot water, which is drained from the agglomerates and recirculated thus reducing energy requirements.

10 Claims, 1 Drawing Figure

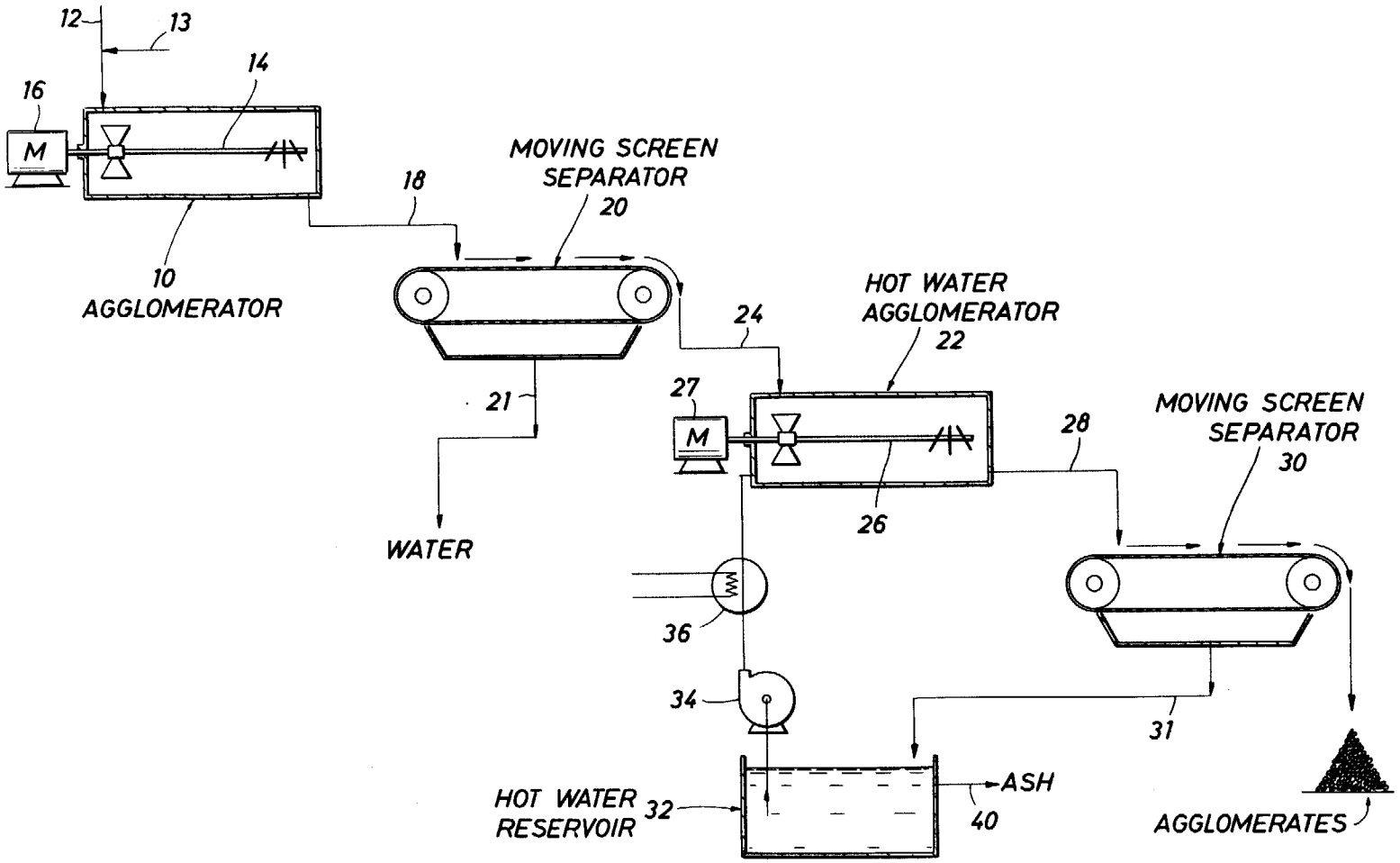
AGGLOMERATES
MOVING SCREEN SEPARATOR 30
31
28
HOT WATER AGGLOMERATOR 22
26
ASH
40
24
27
M
36
34
32
HOT WATER RESERVOIR
MOVING SCREEN SEPARATOR 20
21
WATER
18
14
13
12
16
M
10
AGGLOMERATOR

PROCESS FOR THE AGGLOMERATION OF SOLIDS

BACKGROUND OF THE INVENTION

This invention relates to a process for the agglomeration of finely divided solids, and in particular those in the form of an aqueous suspension.

In general, agglomeration is carried out by subjecting finely divided solids to turbulence in the presence of a binder which is capable of wetting the surface of the solids. Selective agglomeration takes place when the binder alone, or possibly in the presence of another agent, wets the surface of the solids preferentially over that of any contaminating material present.

Agglomeration is used for upgrading finely divided solids such as ores, and in particular coal, and also to facilitate dewatering. Selective agglomeration is useful for the enrichment of ores and for separating coal from gangue.

Hydrocarbon binders, such as bitumen, coal tar, short residues and the like, tend to produce good agglomerates. In choosing a binder for selective agglomeration much more care has to be taken. In general the most selective binders tend to be the lighter hydrocarbons, but these do not always produce the best agglomerates.

The present invention not only seeks to provide harder agglomerates, but also to reduce the energy input necessary for their production.

SUMMARY OF THE INVENTION

In accordance with the invention a process for the agglomeration of finely divided solids in an aqueous suspension comprises passing the suspension through a first zone where it is subjected to turbulence in the presence of a hydrocarbon binder which causes agglomerates to be formed, separating the latter from water and any unagglomerated material, passing the agglomerates to a second zone containing water at a temperature above the softening point of the binder, where they are subjected to turbulence in the presence of a hydrocarbon binder (which need not be the same as the one employed in the first zone), and separating the resulting agglomerates from the hot water and recirculating the latter to the second zone.

Broadly, the present invention pertains to forming agglomerates by vibration in the presence of a binder in two zones, one at a higher temperature than the other, in order to produce higher quality pellets.

DESCRIPTION OF PREFERRED EMBODIMENTS

In practice, the binder for use with the present invention is chosen so that it does not have a viscosity in excess of 4000 $mm^2/s$ at the agglomeration temperature. Where this is not possible, the binder may be emulsified as an unstable emulsion by mixing it vigorously with water at elevated temperature according to known techniques. Stabilized emulsions may also be used as mentioned below.

The process of the invention has the advantage that due to the elevated temperature in the second zone pellets are formed which are hard at ambient temperature, which can be much more easily handled, and thus have a higher market value.

The temperature of the water will advantageously be between 60° C. and 85° C. so that the vessel does not have to be pressurized, but should it be desirable, due to, for example, the type of bitumen to be used, to operate at a higher temperature, then it is of course possible to pressurize the vessel so that the water remains in the liquid phase.

By using a separate charge of water in the second zone, and by recirculating it a large proportion of its heat energy is conserved. Furthermore, a very considerable saving is achieved by not having to heat up the whole of the water phase in which the solids are suspended on entry into the first zone.

It also permits the optional use of a relatively more volatile binder in the first zone, which can improve the selectivity of the agglomeration process. Such a more volatile binder can be partially or wholly recovered in the second zone where it tends to be evaporated off due to the higher temperature obtaining there.

The binder may be a bitumen, coal tar or short residue, whose softening point (R&B) is between 30° C. and 120° C., but as softer binders (those having a softening point between 30° C. and 60° C.) are more effective for selective agglomeration, these tend to be preferred if a single binder is to be used.

Normally, 6 to 12%w binder (based on the solids material to be separated) will be sufficient.

If the binder is introduced without taking any precautions it may not be evenly distributed over the whole of the volume of the zone in which it is introduced or the distribution may be too slow. It is therefore advantageous to do so in the form of an emulsion which dilutes itself rapidly in the obtaining turbulent conditions. Where an emulsifying agent is present it can promote more rapid agglomeration of the solids, perhaps due to the emulsifying agent improving the wetting properties of the binder on the solids or the compaction of the particles.

Often emulsifiers used for bitumen emulsions comprise essentially alkaline soaps of higher fatty acids but these may only be moderately suitable for this purpose. Better results can sometimes be obtained with a special emulsion prepared with approximately 3% by weight (based on the proportion of bitumen) of alkaline naphthenate. Where more rapid agglomeration takes place this evidently can result in additional energy and cost savings.

Where some of the binder is to be added only in the second zone, it may be introduced in powdered form such as powdered bitumen whose softening point (R&B) is below the temperature obtaining in the second zone.

The invention is particularly suitable for upgrading and dewatering coal slurries either after pipeline transport or of normal run-of-mine fines. In such slurries the fines usually have a maximum dimension of up to, say, 1 to 2 mm and as such are difficult to handle; they must also remain relatively wet to prevent dusting. After treatment in accordance with the invention they are in the form of relatively hard pellets having a diameter of up to 20 mm—the larger the pellets desired, the longer they must be submitted to the turbulence, and thus the more expensive they are. The pellets will also have a reduced water content which is acceptable to customers wishing to use them in conventional coal-burning applications.

In addition, where the solids enter the agglomeration process with contaminating matter, the resulting pellets will normally contain a significantly lower porportion of the contaminating material due to the selectivity of the first agglomeration step. If still more selectivity is required, an intermediate grinding step may be introduced after the first zone, in which the loose agglomerates are reground. They are then passed to an intermediate zone or even the above-mentioned second zone for more selective reagglomeration to remove a proportion of the impurities.

The invention will be further described by way of example with reference to the accompanying drawing, which is a flow scheme of an agglomeration process in accordance with the invention for a coal slurry comprising an aqueous suspension of coal fines and some gangue.

The slurry with a proportioned hydrocarbon binder enters a first zone or vessel 10 by lines 12 and 13 and is subjected to turbulence by means of a stirrer 14 driven by a motor 16. Loose agglomerates so formed, together with some unagglomerated material and a corresponding quantity of water, leave the first vessel by a line 18 and are separated by means of a moving screen 20. The water and unagglomerated matter are removed through a line 21 and may be recirculated to the first vessel 10 after settling and decanting the excess water and gangue (this step is not shown the flow scheme).

The loose agglomerates are then passed via a line 24 to a second zone or vessel 22 containing hot water. The agglomerates are again stirred vigorously by means of a stirrer 26 driven by a motor 27. After remaining in the second vessel for the desired residence time, the enlarged and hardened agglomerates in pellet form leave the vessel by line 28 with a corresponding quantity of water and are pased over a screen 30. Dewatered agglomerates can then be stored in heaps, bins or hoppers.

The hot water drained from the agglomerates is passed via a line 31 to a reservoir 32 whence it is recirculated by a pump 34 via a heat exchanger 36 in which it is reheated to the desired operating temperature of the second vessel 22. Ash is removed from the reservoir 32 by a line 40 and may conveniently be recirculated to the first vessel. Unagglomerated particles are recirculated to the second vessel with the water.

In a typical case a dilute coal slurry containing 9 $m^3$ of water to 3 tons of hard coal fines having a maximum dimension of 1 mm and an ash content of 17% is introduced into a first vessel 10 together with 20% by weight (based on the coal) of an unstabilized 50% emulsion of bitumen having a penetration 50–60 pen at 25° C. (softening point approximately 50° C.). After a mean residence time of 15 minutes the corresponding quantity of loose agglomerates and water and ash are passed over the screen 20. An amount of 8.3 tons of water are drained together with the unagglomerated ash. The remaining 3 tons of coal agglomerates (now with 8.2% of ash) and 1 ton of water enter the second vessel 22 and are mixed with 8 tons of water at 95° C. to produce a mixture at 80° C. After a residence time of 20 minutes the resulting pellets of 5 to 20 mm diameter are separated from the hot water on the screen 30. They had an average water content of approximately 10% and the ash content had fallen to 7%.

A more effective de-ashing method could have been carried out by introducing a small quantity of a light-hydrocarbon binder such as butane into the first vessel 10, which would necessitate sealing off from the atmosphere the solids between the first and second vessels. Any light hydrocarbon binder remaining in the agglomerates is flashed off due to the higher temperature obtaining in the second vessel and can be recovered. It can be replaced by adding a corresponding quantity of powdered bitumen in the second vessel.

Improved de-ashing of the coal can also be obtained by regrinding the coal between the first and second vessels.

What we claim is:

1. A process for the agglomeration of finely divided solids in an aqueous suspension, said solids being selected from the group consisting of ores and coal, comprising:

passing the suspension through a first zone where it is subjected to turbulence in the presence of a hydrocarbon binder having a softening point between 30° C. and 120° C. which causes loose agglomerates to be formed;

substantially separating the agglomerates from the water; and, passing the agglomerates to a second zone containing hot water and subjecting the agglomerates to turbulence in the presence of a hydrocarbon binder having a softening point between 30° C. and 120° C.

2. A process as claimed in claim 1 including separating the agglomerates from the heated liquid and recirculating the heated liquid to the second zone.

3. The process as claimed in claim 1, in which the hydrocarbon binder is introduced into the first zone in the form of an emulsion.

4. The process as claimed in claim 1, in which the temperature of the heated liquid in the second zone is maintained between 60° C. and 85° C.

5. The process as claimed in claim 1, in which between 4 and 12%w, based on the weight of solids to be separated, of the hydrocarbon binder is added.

6. The process as claimed in claim 1, in which a light hydrocarbon binder is introduced in the first zone to improve the selectivity of the agglomeration of the solids over any contaminating material present and said binder is at least partly removed from the agglomerates in the second zone due to the higher temperature in that zone.

7. The process as claimed in claim 1, in which powdered bitumen is added in the second zone as a binder.

8. A process for the agglomerization of finely divided solids in an aqueous suspension, said solids being selected from the group consisting of ores and coal, comprising, subjecting the solids to turbulence in the presence of a hydrocarbon binder to form agglomerates and then further subjecting the agglomerates to turbulence in the presence of a hydrocarbon binder at a higher temperature, both said hydrocarbon binders having a softening point between 30° C. and 120° C.

9. The process as claimed in claim 8 wherein the higher temperature is above the softening point of the hydrocarbon binder used to form the agglomerates.

10. The process as claimed in claim 8 where the first recited hydrocarbon binder has a lower softening point than the second recited hydrocarbon binder.

* * * * *